US006276493B1

(12) United States Patent
Lacarte Estallo

(10) Patent No.: US 6,276,493 B1
(45) Date of Patent: Aug. 21, 2001

(54) SHAFT MAGNET ASSEMBLY FOR PRODUCING SHAFT INFORMATION OF AN ELEVATOR INSTALLATION

(75) Inventor: José Luis Lacarte Estallo, Saragossa (ES)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/377,194

(22) Filed: Aug. 19, 1999

(30) Foreign Application Priority Data

Aug. 21, 1998 (EP) ..... 98810821

(51) Int. Cl.[7] ..... B66B 3/00
(52) U.S. Cl. ..... 187/391; 187/414
(58) Field of Search ..... 187/391–394, 187/281–284, 900, 414

(56) References Cited

U.S. PATENT DOCUMENTS

| | | | | |
|---|---|---|---|---|
| 1,680,675 | * | 8/1928 | Gale | 187/284 |
| 1,710,066 | * | 4/1929 | Orcutt | 187/284 |
| 1,920,590 | * | 8/1933 | Federsen | 187/284 |
| 4,203,506 | * | 5/1980 | Richmon | 187/284 |
| 5,798,490 | * | 8/1998 | Vairio et al. | 187/284 |

FOREIGN PATENT DOCUMENTS

| | | | |
|---|---|---|---|
| 1 203 436 | | 10/1965 | (DE) . |
| 54-122546 | * | 3/1978 | (JP) . |
| 405254755 | * | 10/1993 | (JP) . |

* cited by examiner

*Primary Examiner*—Jonathan Salata
(74) *Attorney, Agent, or Firm*—Cohen, Pontani, Lieberman & Pavane

(57) ABSTRACT

For fastening a shaft magnet to a guide rail there is provided a holder with clip characteristics, which consists integrally of a foot part, a back part and a front part, at which a recess for reception of the shaft magnet is arranged. The foot part of the holder has a respective reinforcing rib at each side and a first chamfer at the free end. The front part with the recess has a second chamfer. The foot part and the front part in the rest state run slightly towards one another towards their free ends. On pushing of the holder onto the guide rail the foot part and the front part are lightly spread, whereby the holder is firmly clipped to the guide rail by the spring properties of the back part. The shaft magnet can now be placed on the guide rail through the recess. The shaft magnet is fully retained at the guide rail by its magnetic force. The holder and the shaft magnet are firmly connected with the guide rail without outside fastening means and can individually be easily released from the guide rail and be arranged again whatever desired along the guide rail height.

8 Claims, 2 Drawing Sheets

SHAFT MAGNET ASSEMBLY FOR PRODUCING SHAFT INFORMATION OF AN ELEVATOR INSTALLATION

BACKGROUND OF THE INVENTION

1. Field of the Invention

The invention relates to a shaft magnet assembly for generating shaft information of an elevator installation, wherein at least one shaft magnet arranged in an elevator shaft changes the switching state of a magnet switch, which is arranged at an elevator cage, during travel of the elevator cage in the elevator shaft.

2. Discussion of the Prior Art

Magnets arranged in the elevator shaft serve, together with magnet switches arranged at the elevator cage, for the generation of shaft information. During travel of the elevator cage in the elevator shaft the magnet switches the magnet switch, which is usually constructed as a bistable switch, from one switching state into the other switching state, wherein the instantaneous position of the elevator cage in the elevator shaft is determined for the elevator control from the position of the relevant magnets. The magnets arranged, for example, in the region of stories of floors are usually arranged at fastening means, for example at rails with grooves, into which groove blocks are laid. The magnets are displaceable along the rails and are firmly screw-connected to the groove blocks of the rails by means of screws.

A disadvantage of the known equipment is in that expensive fastening means for the magnets is necessary in the region of each story, which causes substantial cost and mounting time.

SUMMARY OF THE INVENTION

Accordingly, it is an object of the present invention to provide a shaft magnet assembly which does not require expensive fastening means. Pursuant to this object, and others which will become apparent hereafter, one aspect of the present invention resides in a shaft magnet assembly having at least one shaft magnet that is arrangeable in the elevator shaft so as to change a switching state of a magnet switch which is arranged at the elevator cage during travel of the cage in the shaft. A holder is provided for holding the magnet in the shaft. The holder and/or the shaft magnet are arranged at a component of the elevator shaft without outside fastening means. The invention meets the object of avoiding the disadvantages of the known equipment and of bringing about a simplifying of the mounting of the shaft magnets.

The advantages achieved by the invention are essentially to be seen in that the means for mounting the magnets are cheap in manufacture and simple in mounting. Further, it is advantageous that the magnets can be mounted without effort at any desired shaft height.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
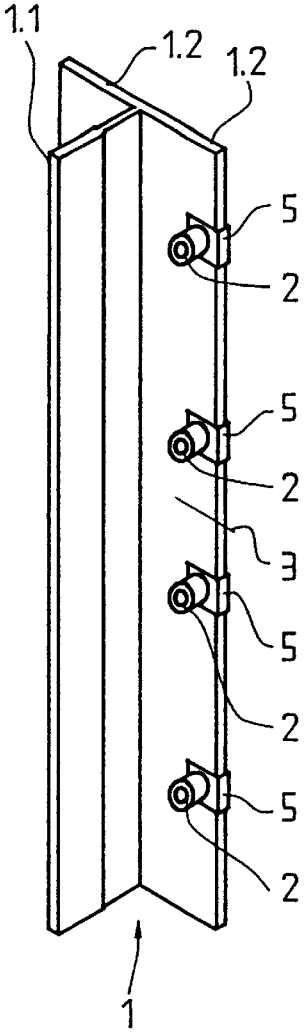
FIG. 1 shows a schematic illustration of a guide rail with shaft magnets placed in position.

A shaft component in the form of a guide rail for guidance of an elevator cage 12 in an elevator shaft 11 is denoted by 1 in FIGS. 1 to 6. The guide rail 1 has a guide limb 1.1 and two holding limbs 1.2. Arranged at one holding limb 1.2 are shaft magnets 2, which change the switching stage of magnet switches 13 arranged at the elevator cage. On the basis of the switching states of the magnet switches, the elevator control recognizes the position of the elevator cage in the elevator shaft and can, for example, correspondingly control the drive. The lowermost shaft magnet 2 shown in FIG. 1 during upward travel of the elevator cage triggers, for example, the switching over of travel speed to crawling speed. Then the elevator cage travels further at crawling speed up to the next story magnet 2, which, for example, causes switching-off of the drive. The elevator cage now stands at a story 3. In a similar manner, the same switching sequence results with the two upper shaft magnets 2 during downward travel of the elevator cage. FIG. 7 schematically shows an elevator installation 10 with the shaft 11, the cage 12 and the magnetic switch 13.

Figure 2:
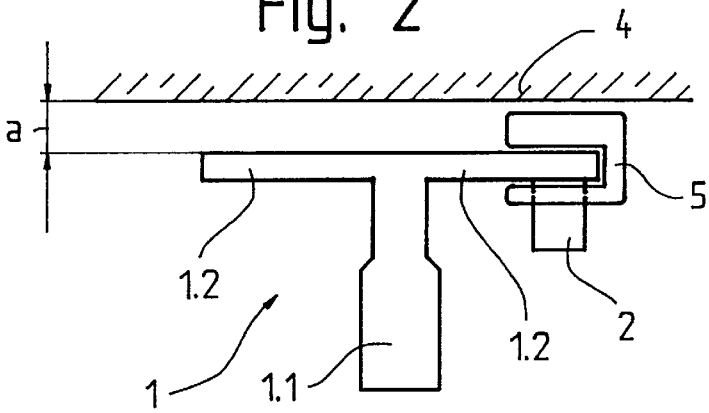
FIG. 2 shows a holder, which is placed on the limb of the guide rail, with a shaft magnet.
Figure 3:
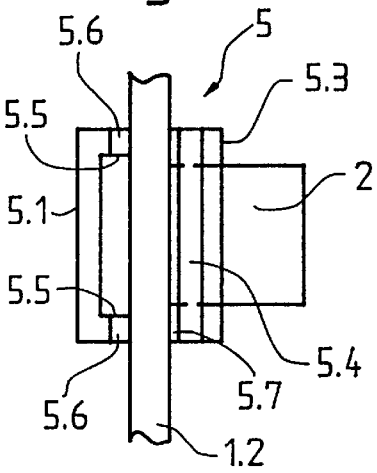
FIG. 3 shows a side view of the holder, which is placed on the guide rail, with a shaft magnet.

FIGS. 2 and 3 show the guide rail 1 arranged, for example, at a shaft wall 4, wherein the guide rail 1 is arranged at a spacing "a" from the shaft wall 4 due to fastening means, which are not illustrated. The spacing a allows pushing of a holder 5 with clip characteristics onto the holding limb 1.2 of the guide rail 1. The holder 5 can receive the shaft magnet 2 placeable on the guide rail 1.

Figure 4:
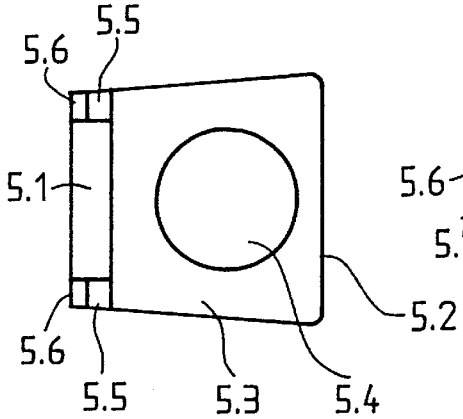
FIG. 4 shows a plan view of the holder.
Figure 5:
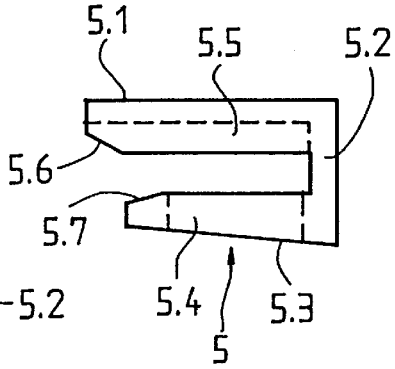
FIG. 5 shows a side view of the holder.
Figure 6:
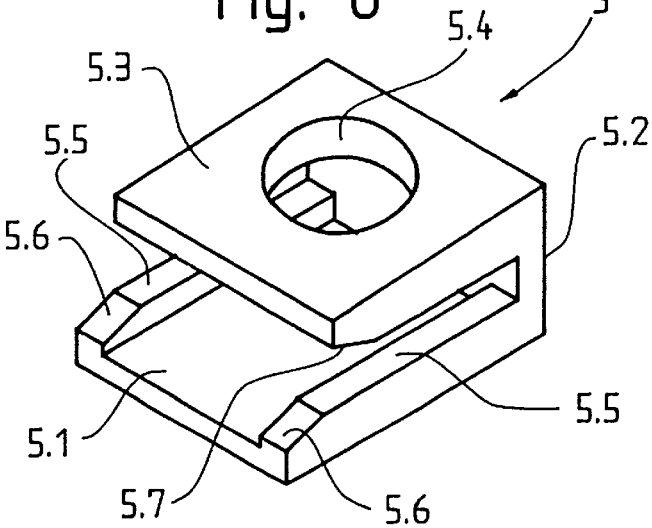
FIG. 6 shows a three-dimensional illustration of the holder.
Figure 7:
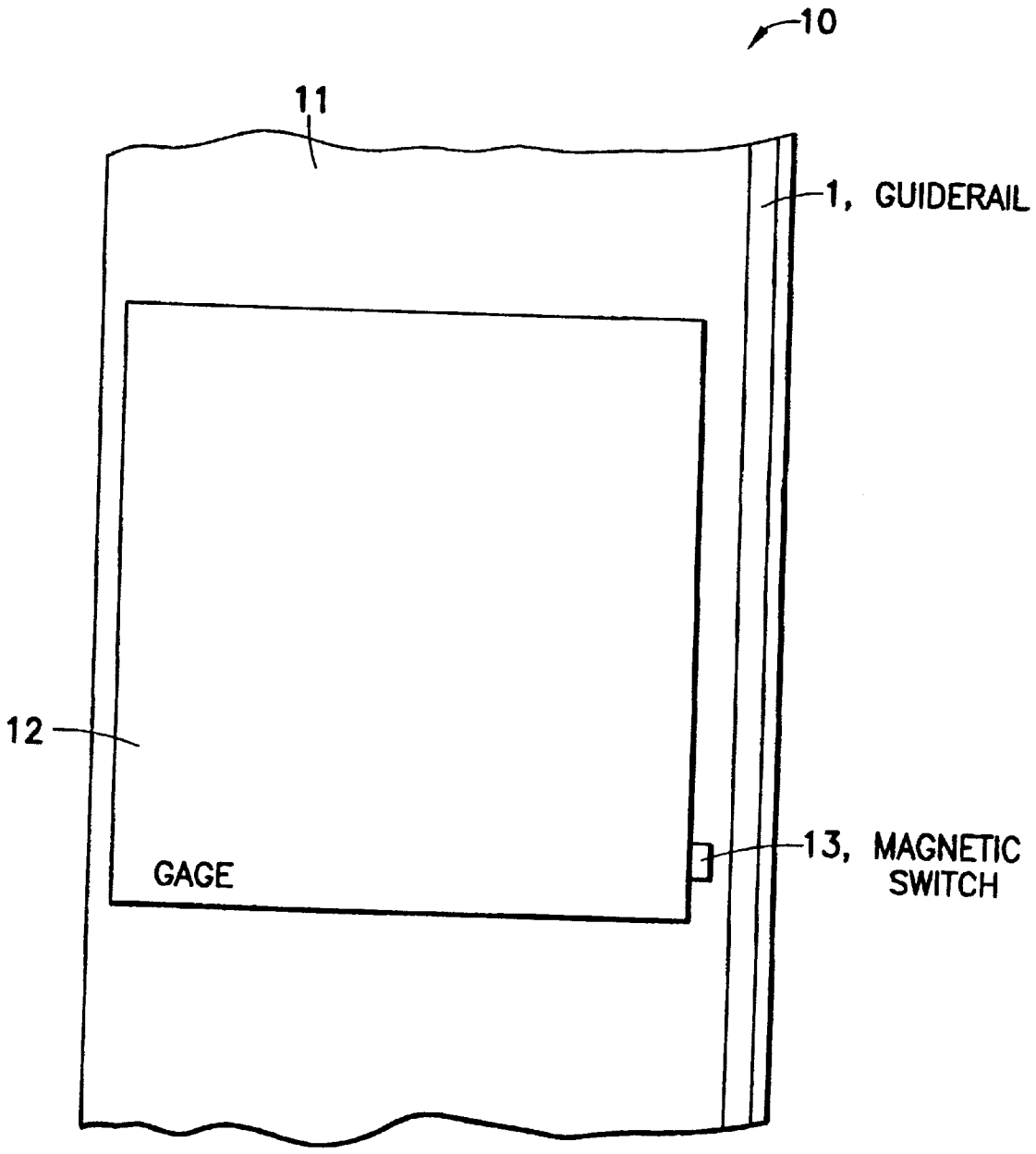
FIG. 7 shows a schematic view of the elevator installation.

FIGS. 4 to 6 show details of the holder 5, which serves as holder and caliper for positioning the shaft magnets 2. The illustrated holder 5 is approximately U-shaped, although other shaping is also possible. The one-piece holder 5 consist of a foot part 5.1, a back part 5.2 and a front part 5.3, at which a recess 5.4, for example a bore, for reception of the shaft magnet 2 is arranged. The shape of the recess 5.4 conforms with the shaft magnet 2 to be received. A shaft magnet 2 which is, for example, rectangular requires a rectangular recess 5.4. The foot part 5.1 of the holder 5 has a respective reinforcing rib 5.5 at each side and a first chamfer 5.6 at the free end. The front part 5.3 with the recess 5.4 has a second chamfer 5.7. The chamfers 5.6, 5.7 facilitate the pushing of the holder 5 onto the holding limb 1.2 of the guide rail 1. The foot part 5.1 and front part 5.3 in the rest state run slightly towards one another towards their free ends, as can be seen in FIG. 5. On pushing of the holder 5 onto the holding limb 1.2 the parts 5.1, 5.3 are lightly spread, whereby the holder 5 is firmly clipped to the holding limb 1.2 by means of the parts 5.1, 5.3 due to the spring properties of the back part 5.2. The shaft magnet 2 can now be placed on the holding limb 1.2 through the recess 5.4. The shaft magnet 2 is firmly retained by its magnetic force at the holding limb 1.2 of the guide rail 1. The holder 5 and the shaft magnet 2 are firmly connected with the guide rail directly and without outside fastening means and can individually be easily released from the guide rail 1 and be arranged again wherever desired along the guide rail height. The holder 5 or the shaft magnet 2 can also be arranged at the guide rail 1 or at other components of the elevator shaft by outside fastening means.

In a further embodiment, the shaft magnets 2 are arranged directly at the guide rail 1 without a holder 5.

The holder 5 and/or shaft magnet 2 can be arranged at the guide rail 1 and/or at other components of the elevator shaft.

The shaft magnet 2 can, without further measures, be removed against its magnetic force from the guide rail 1 and the holder 5 can be withdrawn from the holding limb 1.2 against the friction forces produced on the guide rail 1 by the foot part 5.1 and the front part 5.3.

The invention is not limited by the embodiments described above which are presented as examples only but can be modified in various ways within the scope of protection defined by the appended patent claims.

I claim:

1. A shaft magnet assembly for generating shaft information of an elevator installation having an elevator shaft, an elevator cage and a component in the shaft, the assembly comprising:

at least one shaft magnet arrangable in the elevator shaft so as to change a switching state of a magnet switch which is arranged at the elevator cage, during travel of the elevator cage in the elevator shaft; and a holder for holding the magnet in the shaft, at least one of the holder and the shaft magnet being arranged at the component of the elevator shaft without outside fastening means, the holder being configured to be arranged at the component under a spring force and the shaft magnet being arranged at the component under a magnetic force.

2. A shaft magnet assembly for generating shaft information of an elevator installation having an elevator shaft, an elevator cage and a component in the shaft, the assembly comprising:

at least one shaft magnet arrangable in the elevator shaft so as to change a switching state of a magnet switch which is arranged at the elevator cage, during travel of the elevator cage in the elevator shaft; and a holder for holding the magnet in the shaft, at least one of the holder and the shaft magnet being arranged at the component of the elevator shaft without outside fastening means, the holder having clip characteristics and a recess, the shaft magnet being insertable in the recess so as to be placeable on the component under its magnetic force, the holder and the shaft magnet being together firmly connected with the component and individually easily removable from the component.

3. A shaft magnet assembly according to claim 2, wherein the holder has a foot part, a back part and a front part, the foot part and the front part being connected at one end with the back part so as to run slightly towards one another towards their free ends in a rest state.

4. A shaft magnet assembly according to claim 3, wherein the back part has spring properties so that upon pushing of the holder onto the component the foot part and the front part are lightly spread from the rest state and the holder firmly clips to the component by the spring properties of the back part.

5. A shaft magnet assembly according to claim 3, wherein the foot part has reinforcing ribs and a free end with a first chamber, the front part having a second chamfer, the chamfers being configured so as to facilitate pushing of the holder onto the component.

6. A shaft magnet assembly according to claim 3, wherein the holder has a U-shaped cross-section, the foot part and the front part of the holder forming legs of the U.

7. A shaft magnet assembly for generating shaft information of an elevator installation having an elevator shaft, an elevator cage and a component in the shaft, the assembly comprising:

at least one shaft magnet arrangable in the elevator shaft so as to change a switching state of a magnet switch which is arranged at the elevator cage, during travel of the elevator cage in the elevator shaft; and a holder for holding the magnet in the shaft, at least one of the holder and the shaft magnet being arranged at the component of the elevator shaft without outside fastening means, the holder being configured to be arranged at the component under a spring force.

8. A shaft magnet assembly for generating shaft information of an elevator installation having an elevator shaft, an elevator cage and a component in the shaft, the assembly comprising:

at least one shaft magnet arrangable in the elevator shaft so as to change a switching state of a magnet switch which is arranged at the elevator cage, during travel of the elevator cage in the elevator shaft; and a holder for holding the magnet in the shaft, at least one of the holder and the shaft magnet being arranged at the component of the elevator shaft without outside fastening means, the holder being configured to be arranged at the component under a spring force.

* * * * *